United States Patent [19]

Geary

[11] 4,094,065

[45] June 13, 1978

[54] ANIMAL SHEARING DEVICE

[76] Inventor: William R. C. Geary, 4/18 Kensington Rd., South Yarra, Victoria, Australia, 3141

[21] Appl. No.: 748,203

[22] Filed: Dec. 7, 1976

[51] Int. Cl.[2] ..... B26B 19/24; B26B 19/34

[52] U.S. Cl. ..... 30/210; 30/123.3

[58] Field of Search ..... 30/123.3, 209, 210, 30/200, 224, 208; 92/129, 187; 60/413

[56] References Cited

U.S. PATENT DOCUMENTS

| | | | |
|---|---|---|---|
| 2,844,967 | 7/1958 | Leber | 92/187 |
| 3,393,509 | 7/1968 | Kempson | 60/413 |
| 3,988,828 | 11/1976 | Geary | 30/210 |

*Primary Examiner*—Robert C. Watson
*Attorney, Agent, or Firm*—Holman & Stern

[57] ABSTRACT

A shearing handpiece comprises a body having a cutter arm pivotally mounted thereon between coaxial laterally arranged cylinders each fitted with a plunger which transmits inward movements to the cutter arm by an intervening connecting rod. One at least of the cylinders forms a part of a hydraulic slave motor and the plunger of the other cylinder is preferably constantly urged inwardly by a spring.

Each connecting rod preferably has at each end thereof a semi-spherical head which seats in a corresponding socket in the arm or in the respective plunger as the case may be, these connecting rods being retained in position by the spring.

The slave motor is operable by successive pulses imparted thereto through a flexible connecting tube by a hydraulic pulse generator comprising at least one master cylinder fitted with a power operated master plunger and the handpiece is provided with a control valve operable to isolate the slave motor from the tube.

8 Claims, 9 Drawing Figures

ANIMAL SHEARING DEVICE

This invention relates to hydraulically operable devices, particularly shearing handpieces.

The specification of my prior application Ser. No. 549,053 now U.S. Pat. No. 3,988,828 discloses shearing handpieces and hydraulic pulse generating apparatus for operating various kinds of apparatus including such handpieces and this invention relates to improvements in hydraulic pulse operated shearing handpieces.

More particularly a shearing handpiece as disclosed in my said prior application is provided with a hydraulic "slave" motor operable to actuate the cutter of the handpiece, this motor being connected by a flexible tube to a master cylinder in the pulse generating apparatus. This cylinder is provided with a power operated plunger which imparts pressure pulses in rapid succession to the hydraulic fluid thereby to cause the slave motor to reciprocate in unison therewith.

The general objects of this invention are to provide improvements in hydraulically operable devices, especially shearing handpieces of the aforesaid kind.

Accordingly in one aspect this invention provides a shearing device, especially a shearing handpiece, comprising a body, a cutter actuating arm pivotally mounted on the body, a slave motor cylinder arranged at one side of the arm, a plunger in the cylinder, and a connecting rod extending between and having its opposite ends pivotally connected respectively to the plunger and the arm.

Preferably the said slave motor serves only to displace the pivoted arm outwardly therefrom towards the opposite side of the body in which case displacement of the arm in the opposite direction is effected by a second connecting rod interposed between the arm and the plunger of a second and similar slave motor, or a spring actuated plunger, arranged preferably in coaxial alignment with the firstmentioned motor.

More particularly each connecting rod preferably has a semi-spherical head at each end thereof, each such head being seated in a correspondingly shaped socket formed in or provided on the pivoted arm or in or on the respective motor or spring actuated, plunger as the case may be.

The invention also provides a hydraulic pulse operated shearing device provided with a swivel union by which the adjacent end of a flexible hydraulic tube may be connected to the body thereby to enable a torsionally stiff hydraulic tube to be used without unduly restricting the freedom of movement of the shearing device.

Still another aspect of the invention resides in a shearing handpiece or other device incorporating a hydraulic pulse motor wherein the body is provided with a manually operable valve by which the transmission of pulses to the hydraulic motor may be prevented while the pulse generating apparatus continues to operate, this valve preferably being normally resiliently maintained in its open position.

Still other features of the invention are hereinafter described.

Figure 1:
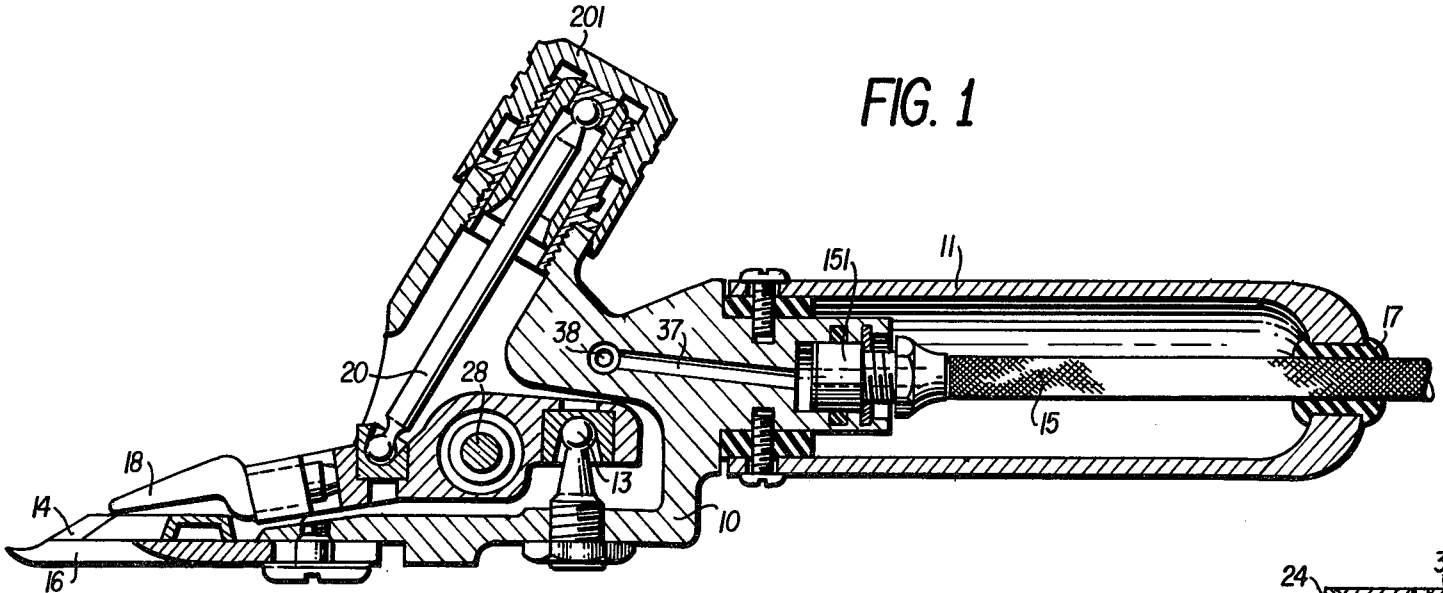
Figure 2:
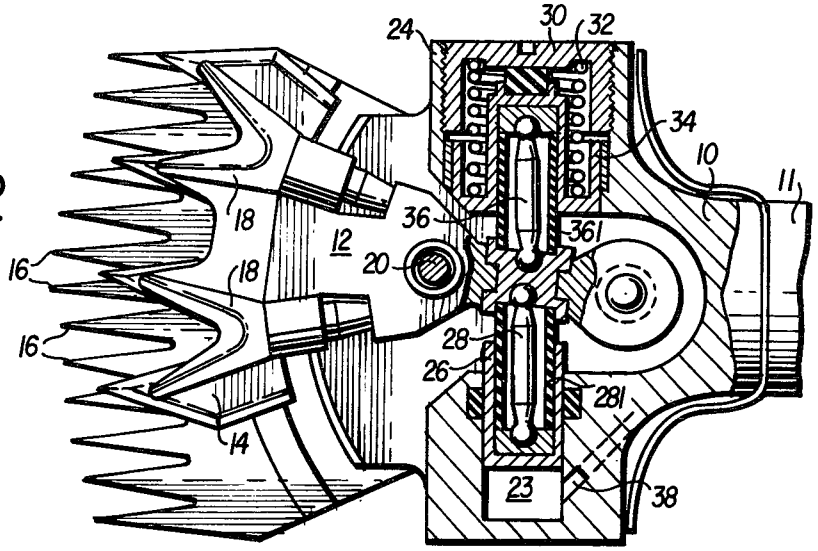
Figure 3:
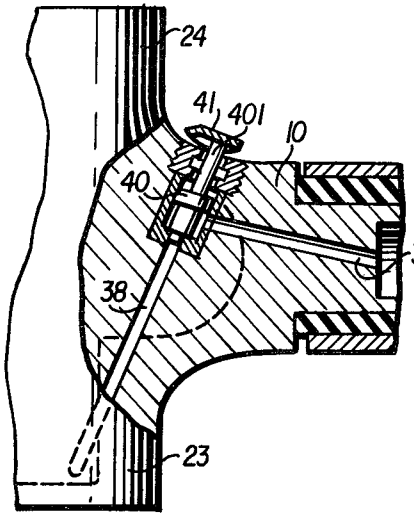
Figure 4:
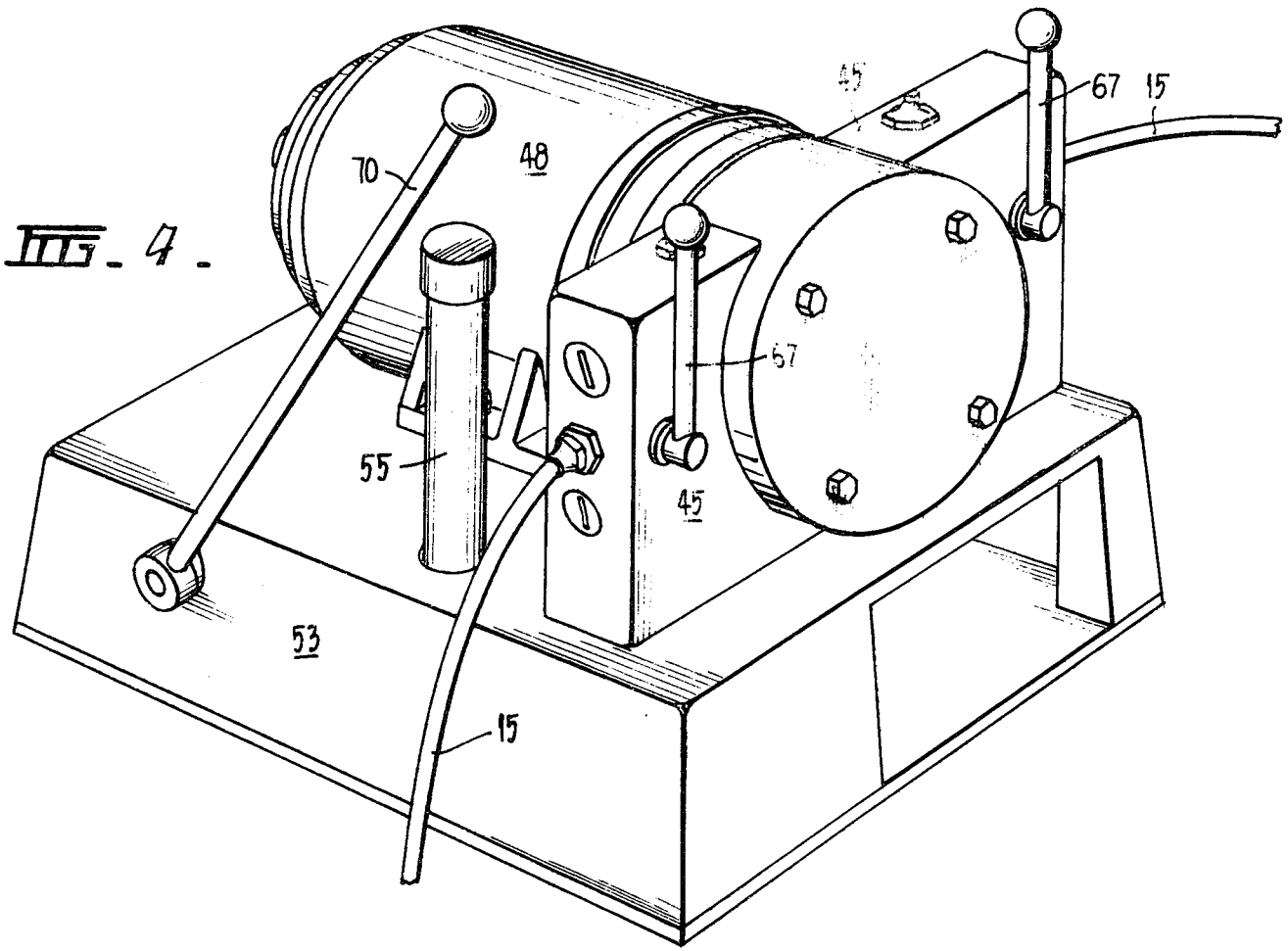
Figure 5:
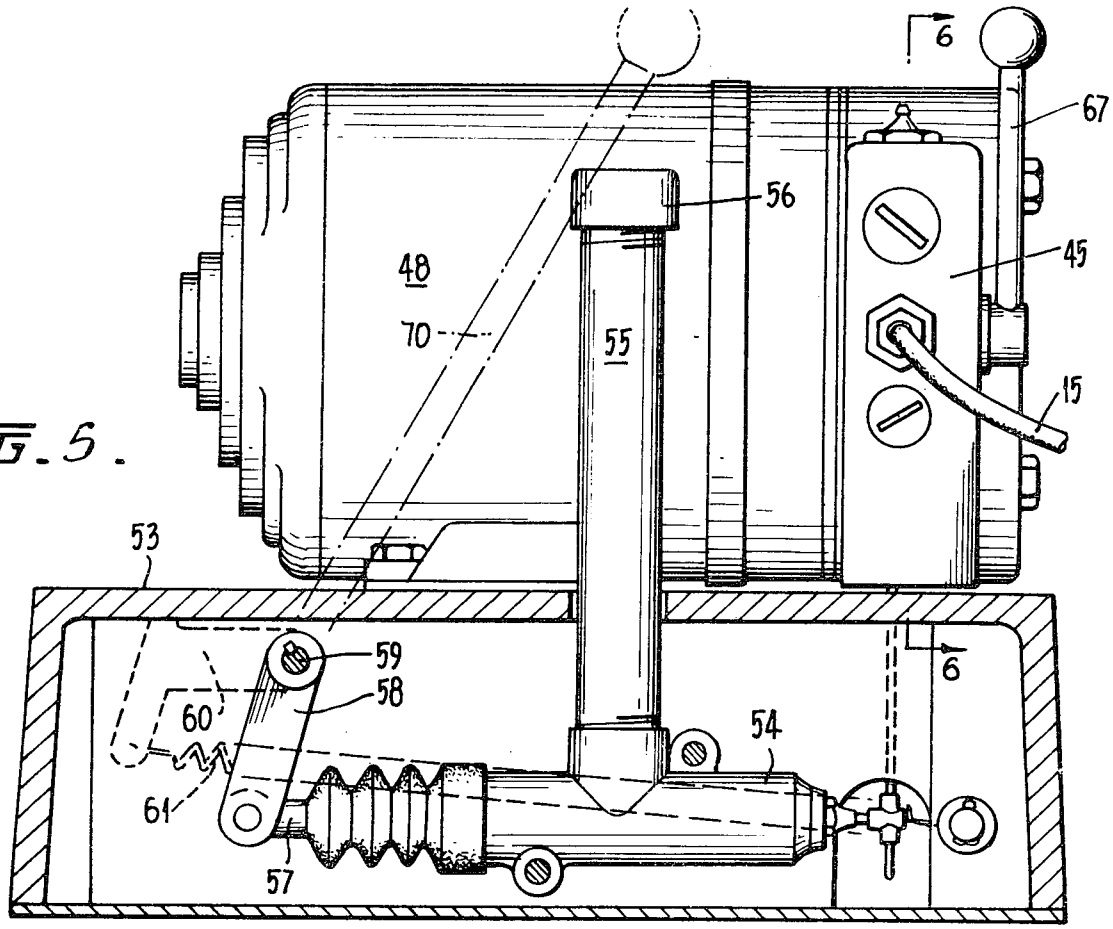
Figure 6:
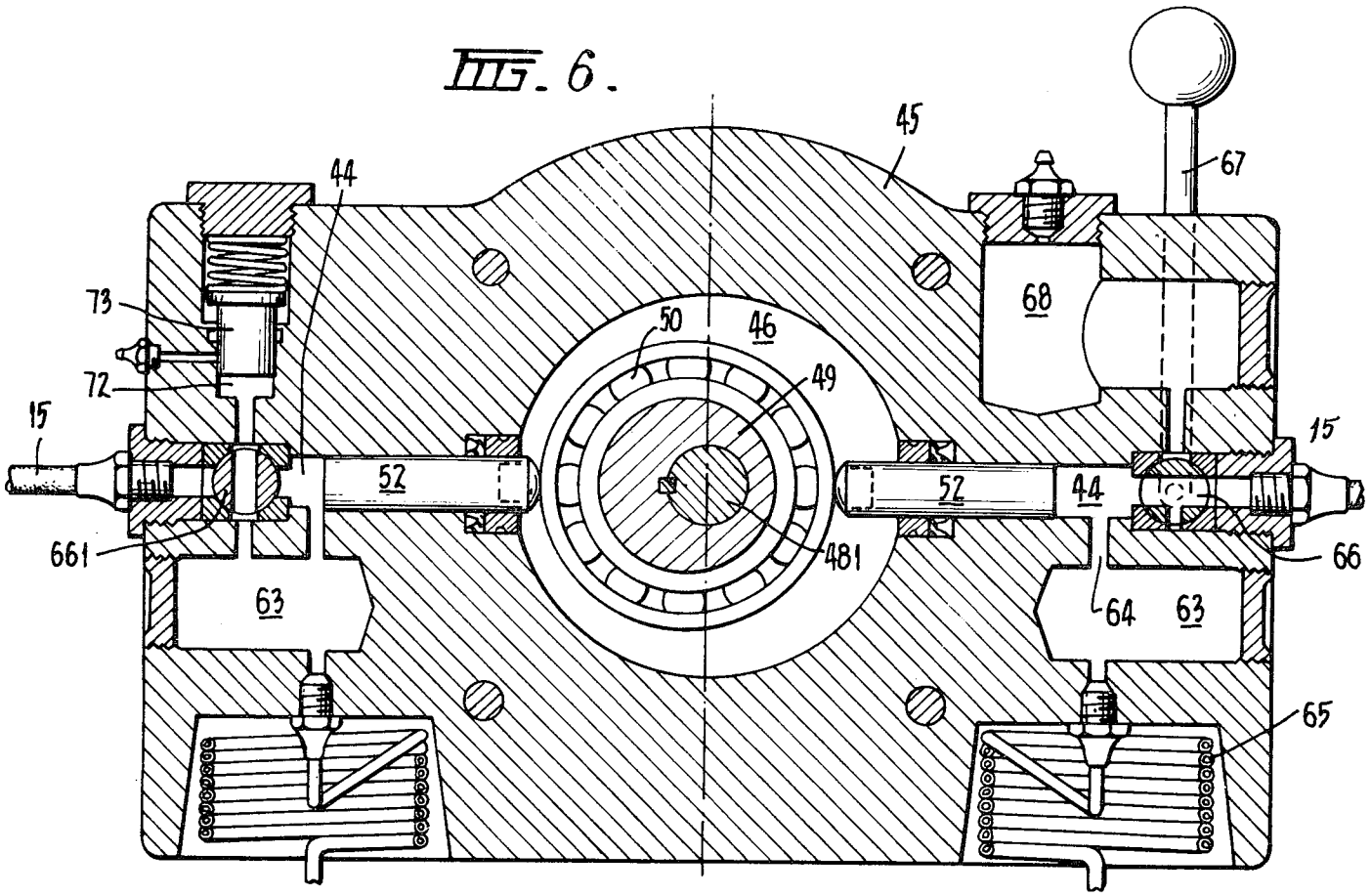
Figure 7:
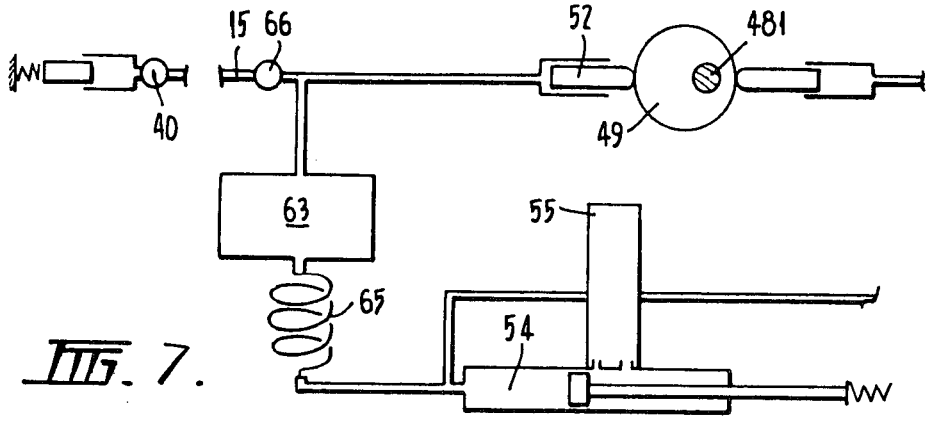
Figure 8:
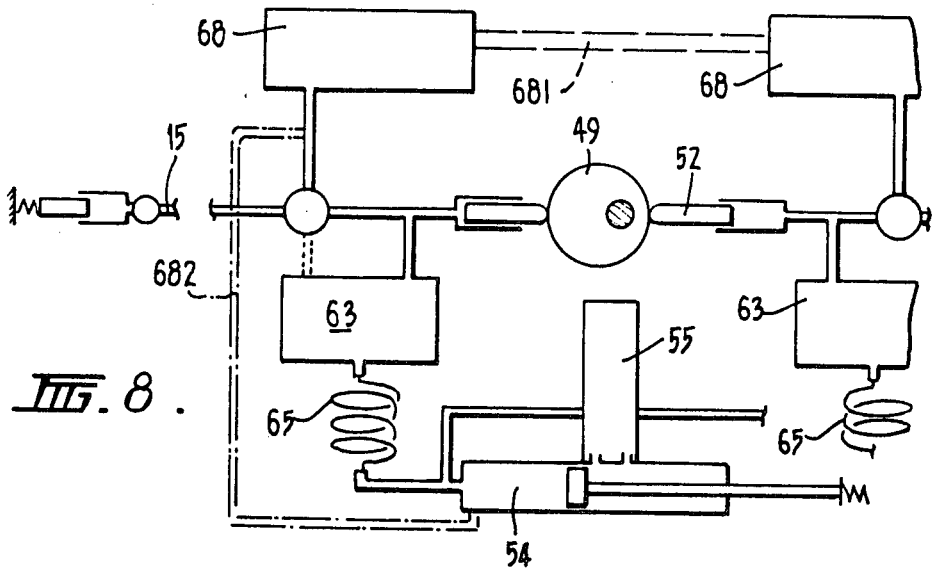
Figure 9:
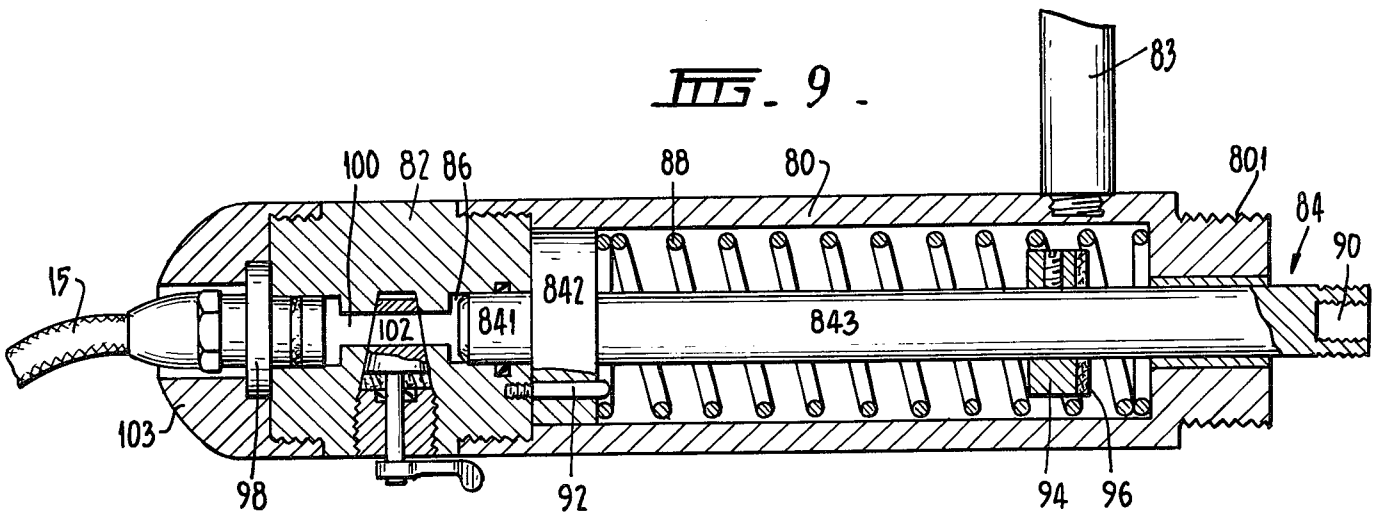

In the accompanying drawings which illustrate preferred forms of the invention:

FIG. 1 is a view in sectional side elevation of a shearing handpiece in accordance with the invention, FIG. 2 is a view in plan, partly in section, of the forward portion of the handpiece, FIG. 3 is a view in sectional side elevation of a portion of a handpiece provided with a manually operable shut-off valve, FIG. 4 is a perspective view of a hydraulic power pulse generator assembly, FIG. 5 is a view in side elevation, and partly in section of the generator assembly, FIG. 6 is a view sectional end elevation taken on the line 6—6 of FIG. 5, FIG. 7 is a diagrammatic view of the basic hydraulic system of the generator, FIG. 8 is a diagram showing modifications of the basic system to facilitate absorption of energy pulses when the output line is closed, and FIG. 9 is a view in sectional side elevation of a power operated tool holder.

Referring initially to FIGS. 1 and 2 the shearing handpiece shown therein is generally similar in its main features to a conventional power operated handpiece and is still more similar to the hydraulically operated handpiece described in the specification of my aforesaid prior specification Ser. No. 549,053. Thus the illustrated handpiece comprises a hollow body 10, provided at its near end with a detachable handgrip 11. A longitudinally extending arm or fork 12 is pivotally mounted on a vertically disposed, domed pivot pin 13, fixed to the body, and this pivoted fork is arranged to oscillate a toothed cutter 14 transversely across the face of a conventional fixed comb 16 which is detachably secured to the forward end of the body and which forms a coacting cutting member.

For this purpose, the forward end portion of the pivoted arm is forked or bifurcated and each free end portion thereof is fitted, as is usual, with a pair of so-called "crows feet" 18, the free forward ends of which engage locating depressions in the upper face of the cutter 14.

The handpiece is also provided with a conventional inclined compression strut 20 which by operation of a screw cap 201 is adapted to exert a sufficient downward pressure on the pivoted arm forwardly of the pivot pin 13.

The body 10 is provided forwardly of the pivot pin 13, and on the opposite sides of the pivoted arm 12, with two transversely arranged coaxial cylinders comprising a hydraulic motor cylinder 23, which is closed at its outer end, and a cylinder 24 which forms a housing for a helical compression return spring 32.

The hydraulic cylinder 23 is fitted with a slidable plunger 26 which is suitably sealed thereto and the inward movements of which are transmitted to the pivoted arm 12 by a connecting rod 28. This rod is provided at each end with a semi-spherical head which engages a correspondingly shaped socket in the plunger or in the adjacent side of the arm 12, as the case may be, it being understood that each of these bearing sockets may be formed in a separate member secured either to the plunger or the arm. The diameter of the semi-spherical heads is preferably as small as the materials used and the loads imposed thereon, will resonably permit, thereby to reduce the area of rubbing contact. In this connection it will be understood that although the angular movements of the connecting rod are small, it is important to reduce frictional resistance and consequent heat generation, as the cutter is commonly oscillated at rates of the order of 3,000 cycles per minute.

Preferably the common axis of the cylinders 23 and 24 is disposed in or close to the inclined plane which contains the comb contacting surface of the cutter 14 and the centre of the spherical head of the pivot pin 13, thereby to avoid any tendency for the cutter arm to be tilted sidewise by the connecting rods.

The outer end of the compression spring 32 abuts against a screw cap 30 adjustably mounted in the outer end of the cylinder 24, while its inner end bears against a slidable plunger 34 formed centrally with a well the closed end of which is formed with a semi-spherical socket to receive the outer end of a second and similar connecting rod 36 and the inner end of this rod engages a seating in the adjacent side of the pivoted arm 12.

It will be apparent from an inspection of FIG. 2 that the assembly, comprising the fork, the plungers 26 and 34 and connecting rods 28 and 36, is at all times maintained under pressure, by the spring 32 so that each end of the each connecting rod is maintained firmly in its respective socket.

Each of the connecting rods 28 and 36 is preferably completely enclosed within a sleeve designated 281 and 361 respectively which is conveniently formed of rubber or a suitable synthetic plastics material. These sleeves prevent the entry of wool, dirt and the like and may also serve as lubricant containers.

In order to remove and replace the cutter 14, it is necessary to raise the forward end of the pivoted fork or arm 12, clear of the cutter and it will be apparent that the ball joints at the opposite ends of the connecting rods also freely permit the raising and lowering movements of the pivoted arm.

In use the hydraulic cylinder 23 is permanently connected to a hydraulic pulse generator (hereinafter described) by means of a flexible tube 15 which extends axially and loosely through a grommet 17, in the free rear end of the handgrip 11, to a sealed swivel joint 151 at the rear of the body 10 as shown in FIG. 1. For the reason hereinafter explained it is preferred to use a flexible tube, e.g. a steel braided tube, which substantially resists expansion by the pressure pulses transmitted through it. Such a tube is also stiffly resistant to torsion and the aforesaid swivel joint is provided so that this torsional stiffness does not unduly restrict the free movement of the handpiece. For this reason also the grommet 17 permits the tube to turn freely therein.

Passages 37 and 38 formed in the body 10 connect the adjacent end of the tube 15 to the outer end of the hydraulic cylinder 23 as shown in FIGS. 1 and 2.

In the modification shown in FIG. 3, a manually operable shut-off valve 40 is mounted in the body 10, just forwardly of the handgrip so as to be readily actuated by the thumb of the operator in order to prevent the flow of hydraulic fluid to the cylinder 23. The valve is normally maintained in its raised open position by the pressure of the fluid at which time its upper end 401 projects from the body so as to be disposed close to or in contact with the underside of a pivoted or resilient actuating member 41. Thus by depressing this member 41 the valve 40 is pressed onto its seat to prevent the transmission of pressure pulses to the cylinder 23 and prevent further operation of the cutter arm.

When however the member 41 is subsequently released the valve 40 reopens and the cutter arm is again operated.

The return spring 32 and its housing cylinder 24 may, if desired, be replaced by a second hydraulic motor cylinder identical with the motor 23 in which case the plunger of this second motor is actuated by pressure pulses which are opposite in phase to those supplied to the cylinder 23 as hereinafter described whereby as either motor plunger is projected by a pressure pulse, the other is retracted.

The detachable handgrip 11 is preferably resiliently mounted on the body as shown to reduce the transmission of vibration to the hand of the user while its forward end is preferably provided with upwardly flared wings as shown to maintain the hand of the user out of contact with the metal body 10. For this purpose the handgrip and wings may advantageously be formed of a suitable plastics or other suitable non-conductive material.

The hydraulic pulse generating apparatus hereinafter described imparts successive pressure pulses to the hydraulic fluid at a suitable frequency so that each such pulse serves to project the hydraulic plunger 26 inwardly and thereby displace the pivoted cutter arm 12 in opposition to the return spring 32, while in the intervals between such pulses, this spring returns the cutter arm in the opposition direction. Thus, the cutter is oscillated at a predetermined frequency across the face of the comb 16.

At its opposite end, the flexible tube 15 is connected to the closed outer end of a corresponding master cylinder 44 in hydraulic generating apparatus, a preferred form of which is shown in FIG. 4, 5 and 6, this generating apparatus being arranged in any convenient fixed position adjacent the shearing area.

This illustrated power generating apparatus comprises at least one diametrically opposed pair of master cylinders 44 each of which may be connected to a corresponding shearing handpiece or other tool, and it will be understood that any required number of pairs of such cylinders 44 may be provided.

The master cylinder 44 are formed horizontally in a cylinder block 45 which is secured to the adjacent end of an electric motor 48, the spindle 481 of which is extended through a relatively large central opening 46 formed in the block. The motor spindle is provided within the said opening with an eccentric 49 to which is fitted a ball race 50 disposed in alignment with the cylinders 44.

Each master cylinder is fitted with a plunger 52 which projects from the inner end thereof into engagement with the outer ring of the ball race and it is maintained in contact therewith by the pressure of the fluid within the cylinder as hereinafter described.

Thus as the motor spindle is rotated the eccentric causes the plungers 52 to reciprocate in opposite phase during which time the outer ring of the ball race 50 undergoes but little angular movement so that rubbing contact between it and the plungers 52 is minimal.

A reservoir cylinder 54 for the hydraulic fluid, and which may conveniently be a master cylinder as used in an automobile braking system, is supported within a hollow base 53 for the motor, as shown in FIG. 5, and a filling tube 55 which extends upwardly therefrom is normally closed and sealed by a removable cap 56.

The fluid in this cylinder, which is common to the opposed pair of cylinders 44, is maintained under a suitable and sufficiently constant pressure by a plunger, not shown, which is connected by a pivoted rod 57 to an arm 58 on a spindle 59.

The spindle 59 is also fitted with an angular arm 60, shown in broken lines, which has its free end connected to one end of a tension spring 61, the opposite end of which is suitably anchored to the base. This arm 60 is so arranged that the leverage exerted on the spindle 59 by the spring 61 is progressively increased as the spring contracts whereby the pressure maintained within the reservoir cylinder remains approximately constant.

In order to supply additional fluid to the reservoir cylinder 54 the cocking lever 70 is moved clockwise, in opposition to the spring 61 to retract the piston in the reservoir cylinder behind the inflow ports at the bottom of the filling tube and thus permit additional fluid to pass into the cylinder.

The inner end of the reservoir cylinder is in constant communication with each of the opposed pair of master cylinders 44 for which purpose a capacitor chamber 63 is provided in the cylinder block adjacent to each cylinder 44 and is in constant communication with it by a passage 64.

Each chamber 63 also communicates with the adjacent end of a corresponding restrictor tube 65 of small diameter and sufficient length, which is conveniently accommodated in coiled form within a compartment in the block, as shown in FIG. 6, and the other end of each of these tubes communicates with the interior of the reservoir cylinder.

The functions of the capacitor chambers 63 and restrictor tubes 66 are hereinafter described.

The outer end of each master cylinder is normally connected to the adjacent end of the respective flexible tube 15 attached at its opposite end to a shearing handpiece, or other tool and a rotary shut-off valve 66 or 661 which is operable by a hand-lever 67 is arranged in the cylinder block between each cylinder and the corresponding flexible tube 15.

These shut-off valves may be of any suitable type and for convenience in description, somewhat different valves and pulse absorption facilities are shown at the right and left of FIG. 6. Thus the valve 66 shown at the right of the Figure is of the three-way circuit selector type, so that as the handlever is completing a clockwise movement through an angle of 90° to close communication between the cylinder and the tube 15, the cylinder is connected to an auxiliary capacitor chamber 68 formed in the cylinder block.

When the electric motor is operating, each master plunger 52 imparts pressure pulses in rapid succession to the fluid in its cylinder and when the shut-off valve 66 is in its normal open position, shown in FIG. 6, these pulses are transmitted through the flexible tube 15 to the corresponding handpiece, while the capacitor chamber 63, in conjunction with the capacity of the tube 15, serves to absorb the peak pulse pressure, if the shut-off valve 40 on the handpiece is closed, or if the handpiece should jam, while the pulse generator continues to operate.

When the total capacity provided by the chamber 63 and the tube 15, is appropriately selected, the pulses transmitted to the said chamber are substantially prevented from passing to the reservoir chamber, by the resistance of the coiled tube 65 which however still permits makeup fluid to pass therethrough from the reservoir cylinder 54 to the capacitor chamber 63 to replace leakage. In this connection it will be understood that if the total pulse absorption capacity is excessive, the power transmitted to the handpiece may be insufficient while, if the pulse absorption capacity is inadequate, fluid may be forced through the restrictor tube 65 into the reservoir chamber and if this should occur the master piston may lose contact with the eccentric as, due to its inertia, the fluid thus forced back into the reservoir would return relatively slowly. It is important therefore for the constants of the power generator and the handpiece to be compatible.

When however the shut-off valve 66 in the cylinder block is closed, the capacity of the tube 15 is not available to assist in softening and absorbing the pressure pulses, and for this reason the master cylinder is simultaneously connected by that valve to the auxiliary capacitor chamber 68 which then together with the capacitor 63 absorbs the pulses while the generator continues to operate.

The valve 661 shown at the left of FIG. 6 of the two-way type and, when arranged as shown in the Figure, the tube 15 is disconnected from its cylinder 44 while the capacitor chamber 63 is connected by the valve to a cylinder 72 provided with a spring loaded plunger 73 which is thus displaced upwardly to absorb the energy of the pulses. It will be evident however that this plunger and spring could if desired by replaced by a resilient diaphragm, while, alternatively, both the cylinder and the plunger could be substituted by a resilient tube which expands and contracts with the pulses.

The basic form of the hydraulic system of the pulse generator is diagrammatically shown in FIG. 7 while FIG. 8 shows several modifications of this circuit in order to further soften or absorb the pulses when the output valve 66 of the generator or the shutoff valve 40 of the slave motor, is closed.

FIG. 7 requires no further explanation but FIG. 8 which includes the auxiliary capacitor chambers 68 shows in broken lines a passage 681 which may permanently connect these two chambers. When both output valves 66 are closed so as to connect the master cylinders 44 to their respective auxiliary chambers 68, the fluid may be freely displaced from each cylinder in turn to the other, as the two master plungers are forced inwardly alternately and so are 180° out of phase.

Also when only one of the output valves 66 is closed the capacities of both auxiliary chamber 68 are then available to absorb the pulses produced in the corresponding cylinder.

Alternatively the axuiliary chambers 68 may be omitted by using the reservoir cylinder 54 as an additional capacitor, such as by connecting the upper part of the valve 66 to the reservoir cylinder by a tube 682 shown in broken lines in the Figure.

I claim:

1. A shearing device comprising a body provided with a pivoted arm for oscillating a cutter across the face of a comb fixed to the body, a hydraulic cylinder arranged laterally on the body at one side of the pivoted arm and forwardly of the pivotal axis thereof, a plunger in the cylinder, a connecting rod extending between the plunger and the arm so as to transmit inward movements of the plunger to the arm and thereby displace the latter towards the opposite side of the body, means for attaching a hydraulic supply tube to the body thereby to connect the interior of the cylinder to hydraulic pulse generating apparatus, a second cylinder on the body at the opposite side of the pivoted arm and in coaxial alignment with the firstmentioned cylinder, a plunger in said second cylinder, and a second connecting rod extending between the lastmentioned plunger and the arm thereby to displace the latter towards the firstmentioned side of the body when the secondmentioned plunger is moved inwardly; each connecting rod having a semi-spherical head at each thereof which is seated in a correspondingly shaped socket on the respective plunger or pivoted arm, and the connecting rods are maintained in engagement with the coacting socket by the inward pressures constantly exerted on the opposed plungers.

2. A shearing device according to claim 1 including means whereby a second hydraulic supply tube may be attached to the body thereby to connect the hydraulic pulse generating apparatus to said second cylinder for the transmission to the latter of hydraulic power pulses in opposite phase to the pulses transmitted to the first-mentioned cylinder.

3. A shearing device according to claim 1 wherein said second cylinder forms a housing for a spring which constantly urges the respective plunger inwardly towards the pivoted arm.

4. A shearing device according to claim 1 including a swivel union by which the supply tube is connected to the body.

5. A shearing device according to claim 1 including a normally open valve in the body and manually operable means for closing the valve thereby to prevent the transmission of fluid pulses to the hydraulic cylinder.

6. A shearing device according to claim 1 including a sleeve enclosing each connecting rod and extending from the pivoted arm to the respective plunger thereby to exclude dust, wool and the like.

7. A shearing device according to claim 1 including a handgrip resiliently mounted on the body thereby to minimise the transmission of vibrations to the hand of the operator, and wherein the inner end of the handgrip is provided with outwardly projecting wings to prevent contact between the hand of the operator and the said cylinders.

8. A shearing device according to claim 1 in combination with hydraulic power pulse generating apparatus therefor, said pulse generating apparatus comprising at least one master cylinder provided with a reciprocable plunger operable by a driving motor, thereby to impart successive pressure pulses to a hydraulic fluid filling the cylinder and an outlet passage which communicates therewith, means for normally maintaining the fluid under a predetermined minimum or base pressure, a flexible hydraulic tube normally connecting the master cylinder to said hydraulic cylinder in the shearing device whereby the plunger in said last mentioned cylinder is constrained to operate in unison with the pressure pulses produced in the master cylinder, a shut-off valve operable to isolate the connecting tube from the master cylinder, and means comprising a capacitor chamber for absorbing the pressure pulses produced in the master cylinder when the shut-off valve is closed and the driving motor continues to operate.

* * * * *